US007204106B2

(12) United States Patent
Merrem et al.

(10) Patent No.: US 7,204,106 B2
(45) Date of Patent: Apr. 17, 2007

(54) PORTABLE ELECTRONIC DEVICE PHYSICAL SECURITY

(75) Inventors: Ralph Merrem, San Francisco, CA (US); Jay S. Derman, Palos Verdes Peninsula, CA (US)

(73) Assignee: ACCO Brands USA LLC, Lincolnshire, IL (US)

( * ) Notice: Subject to any disclaimer, the term of this patent is extended or adjusted under 35 U.S.C. 154(b) by 228 days.

(21) Appl. No.: 10/849,397

(22) Filed: May 18, 2004

(65) Prior Publication Data

US 2005/0028571 A1 Feb. 10, 2005

Related U.S. Application Data

(63) Continuation-in-part of application No. 09/930,122, filed on Aug. 13, 2001, now abandoned.

(51) Int. Cl.
*E05B 73/00* (2006.01)

(52) U.S. Cl. ..... 70/14; 70/58; 248/551

(58) Field of Classification Search ..... 70/14, 70/18, 19, 57, 58, 158–164; 248/551–553
See application file for complete search history.

(56) References Cited

U.S. PATENT DOCUMENTS

| | | | |
|---|---|---|---|
| 87,045 | A | 2/1869 | Holmes |
| 153,673 | A | 8/1874 | Fox |
| 285,074 | A | 9/1883 | Rhoades et al. |
| 505,299 | A | 9/1893 | Schneider |
| 606,734 | A | 7/1898 | Olmstead |
| 611,646 | A | 10/1898 | Parker |
| 786,842 | A | 4/1905 | Robeson |

(Continued)

FOREIGN PATENT DOCUMENTS

| | | |
|---|---|---|
| CA | 454901 | 3/1949 |

(Continued)

OTHER PUBLICATIONS

U.S. Appl. No. 10/839,521, Murray Jr., et al.

(Continued)

*Primary Examiner*—Suzanne Dino Barrett
(74) *Attorney, Agent, or Firm*—Townsend and Townsend and Crew LLP

(57) ABSTRACT

An apparatus for attaching to a first wall that defines a security aperture. The apparatus comprises a housing defining a longitudinal axis and a locking flange extending from the housing on a shaft and having a profile that is complimentary to the security aperture, such that the locking flange has a first orientation relative to the security aperture for insertion into and removal from the security aperture, and a second orientation relative to the security aperture for retention within the security aperture. The locking flange is transformable between the first orientation and the second orientation. The apparatus further includes a locking member that is coupled to the housing and is cooperative with the locking flange for inhibiting transformation of the locking flange from the second orientation to the first orientation. The apparatus further comprises at least one leg that is parallel to the first wall. The leg is coupled to the housing with a first coupler that is movable relative to the housing between an open position and a closed position.

7 Claims, 5 Drawing Sheets

U.S. PATENT DOCUMENTS

| | | | |
|---|---|---|---|
| 881,364 | A | 3/1908 | Wheeler |
| 934,928 | A | 9/1909 | Michel |
| 942,537 | A | 12/1909 | Batdorf |
| 952,411 | A | 3/1910 | Billy |
| 1,004,333 | A | 9/1911 | Alsterberg |
| 1,050,276 | A | 1/1913 | Johnson |
| 1,101,450 | A | 6/1914 | Kerry |
| 1,432,546 | A | 10/1922 | Gillom |
| 1,452,471 | A | 4/1923 | Kline |
| 1,470,937 | A | 10/1923 | Schou |
| 1,534,936 | A | 4/1925 | Fishchbach |
| 1,672,333 | A | 6/1928 | Miller |
| 1,707,225 | A | 4/1929 | Jackson |
| 1,786,511 | A | 12/1930 | Warren |
| 1,978,935 | A | 10/1934 | Douglas |
| 2,001,354 | A | 5/1935 | Smith |
| 2,102,583 | A | 12/1937 | Alberg |
| 2,109,109 | A | 2/1938 | Finch |
| 2,130,216 | A | 9/1938 | Zaninovich |
| 2,172,208 | A | 9/1939 | Kutrzon |
| 2,190,661 | A | 2/1940 | Hauer |
| 2,383,397 | A | 8/1945 | Lofquist |
| 2,405,400 | A | 8/1946 | Butterfiled |
| 2,435,876 | A | 2/1948 | De Swart |
| 2,469,874 | A | 5/1949 | Fetsko, Jr. |
| 2,480,662 | A | 8/1949 | McKinzie |
| 2,530,560 | A | 11/1950 | Young |
| 2,577,956 | A | 12/1951 | Eisberg |
| 2,594,012 | A | 4/1952 | Griffin |
| 2,660,084 | A | 11/1953 | Newman |
| 2,677,261 | A | 5/1954 | Jacobi |
| 2,729,418 | A | 1/1956 | Maynard |
| 2,800,090 | A | 7/1957 | Reid |
| 2,963,310 | A | 12/1960 | Abolins |
| 3,091,011 | A | 5/1963 | Campbell |
| 3,101,695 | A | 8/1963 | Honeyman, Jr. |
| 3,130,571 | A | 4/1964 | Neumann |
| 3,136,017 | A | 6/1964 | Preziosi |
| 3,171,182 | A | 3/1965 | Danehy |
| 3,174,384 | A | 3/1965 | Vanni |
| 3,200,694 | A | 8/1965 | Rapata |
| 3,211,408 | A | 10/1965 | Schaefer |
| 3,213,745 | A | 10/1965 | Dwyer |
| 3,220,077 | A | 11/1965 | Newcomer, Jr. et al. |
| 3,276,835 | A | 10/1966 | Hall |
| 3,469,874 | A | 9/1969 | Mercurio |
| 3,486,158 | A | 12/1969 | Soltysik et al. |
| 3,521,845 | A | 7/1970 | Sweda et al. |
| 3,590,608 | A | 7/1971 | Smyth et al. |
| 3,596,285 | A | 7/1971 | Garland |
| 3,625,031 | A | 12/1971 | Alley, III |
| 3,634,963 | A | 1/1972 | Hermann |
| 3,664,163 | A | 5/1972 | Foote |
| 3,722,239 | A | 3/1973 | Mestre |
| 3,727,934 | A | 4/1973 | Averbook et al. |
| 3,737,135 | A | 6/1973 | Bertolini |
| 3,754,420 | A | 8/1973 | Cellerich |
| 3,765,197 | A | 10/1973 | Foote |
| 3,771,338 | A | 11/1973 | Raskin |
| 3,772,645 | A | 11/1973 | Odenz et al. |
| 3,782,146 | A | 1/1974 | Franke |
| 3,785,183 | A | 1/1974 | Sander |
| 3,798,934 | A | 3/1974 | Wright et al. |
| 3,826,510 | A | 7/1974 | Halter |
| D232,416 | S | 8/1974 | Gazda et al. |
| 3,836,704 | A | 9/1974 | Coules |
| 3,859,826 | A | 1/1975 | Singer et al. |
| 3,866,873 | A | 2/1975 | Bohli |
| 3,875,645 | A | 4/1975 | Tucker et al. |
| 3,898,641 | A | 8/1975 | Banner |
| 3,905,570 | A | 9/1975 | Nieuwveld |
| 3,910,079 | A | 10/1975 | Gassaway |
| 3,910,081 | A | 10/1975 | Pender |
| 3,939,752 | A | 2/1976 | Koscik |
| 3,986,780 | A | 10/1976 | Nivet |
| 3,990,276 | A | 11/1976 | Shontz |
| 3,999,410 | A | 12/1976 | Hall |
| 4,003,228 | A | 1/1977 | Lievens et al. |
| 4,004,440 | A | 1/1977 | Dreyer |
| 4,007,613 | A | 2/1977 | Gassaway |
| 4,018,339 | A | 4/1977 | Pritz |
| 4,028,913 | A | 6/1977 | Falk |
| 4,028,916 | A | 6/1977 | Pender |
| 4,047,748 | A | 9/1977 | Whaley et al. |
| 4,055,973 | A | 11/1977 | Best |
| 4,057,984 | A | 11/1977 | Avaiusini |
| 4,065,083 | A | 12/1977 | Gassaway |
| 4,066,195 | A | 1/1978 | Dickler |
| 4,066,231 | A | 1/1978 | Bahner |
| 4,104,951 | A | 8/1978 | Leitner |
| 4,114,409 | A | 9/1978 | Scire |
| 4,118,902 | A | 10/1978 | Saxton |
| 4,123,922 | A | 11/1978 | Kuenstler |
| 4,131,001 | A | 12/1978 | Gotto |
| 4,212,175 | A | 7/1980 | Zakow |
| 4,223,542 | A | 9/1980 | Basseches |
| 4,252,007 | A | 2/1981 | Kerley |
| 4,263,833 | A | 4/1981 | Loudin |
| 4,300,371 | A | 11/1981 | Herwick et al. |
| 4,311,883 | A | 1/1982 | Kidney |
| 4,313,319 | A | 2/1982 | Haus, Jr. et al. |
| 4,337,462 | A | 6/1982 | Lemelson |
| 4,391,110 | A | 7/1983 | Nielsen |
| 4,394,101 | A | 7/1983 | Richer |
| 4,418,550 | A | 12/1983 | Hamilton |
| 4,419,034 | A | 12/1983 | DiMartino |
| 4,442,571 | A | 4/1984 | Davis et al. |
| 4,448,049 | A | 5/1984 | Murray |
| 4,462,233 | A | 7/1984 | Horetzke |
| 4,466,259 | A | 8/1984 | Osgood |
| 4,471,980 | A | 9/1984 | Hickman |
| 4,478,545 | A | 10/1984 | Mizusawa |
| 4,501,460 | A | 2/1985 | Sisler |
| 4,502,305 | A | 3/1985 | Bakker |
| 4,527,405 | A | 7/1985 | Renick et al. |
| 4,570,465 | A | 2/1986 | Bennett |
| 4,579,492 | A | 4/1986 | Kazino |
| 4,584,856 | A | 4/1986 | Petersdorff et al. |
| 4,586,843 | A | 5/1986 | Henge et al. |
| 4,593,273 | A | 6/1986 | Narcisse |
| 4,598,272 | A | 7/1986 | Cox |
| 4,603,829 | A | 8/1986 | Koike et al. |
| 4,610,587 | A | 9/1986 | Wollar |
| 4,616,490 | A | 10/1986 | Robbins |
| 4,620,182 | A | 10/1986 | Keifer |
| 4,640,106 | A | 2/1987 | Derman |
| 4,651,544 | A | 3/1987 | Hungerford |
| 4,654,640 | A | 3/1987 | Carll et al. |
| 4,655,057 | A | 4/1987 | Derman |
| 4,656,848 | A | 4/1987 | Rose |
| 4,667,491 | A | 5/1987 | Lokken et al. |
| 4,676,080 | A | 6/1987 | Schwarz |
| 4,680,949 | A | 7/1987 | Stewart |
| 4,685,312 | A | 8/1987 | Lakoski et al. |
| 4,691,891 | A | 9/1987 | Dionne |
| 4,692,968 | A | 9/1987 | Girard |
| 4,704,881 | A | 11/1987 | Sloop, Sr. |
| 4,733,840 | A | 3/1988 | D'Amore |
| 4,738,428 | A | 4/1988 | Themistos et al. |
| 4,741,185 | A | 5/1988 | Weinert et al. |
| 4,751,831 | A | 6/1988 | Morris, Jr. et al. |
| 4,761,975 | A | 8/1988 | Kachnowski et al. |
| 4,768,361 | A | 9/1988 | Derman |
| 4,770,583 | A | 9/1988 | Lindberg |

4,779,434 A 10/1988 Derman
4,785,291 A 11/1988 Hawthorne
4,801,232 A 1/1989 Hempel
4,804,943 A 2/1989 Soleimani
4,805,426 A 2/1989 Dimmick et al.
4,813,252 A 3/1989 Ray
4,826,193 A 5/1989 Davis
4,834,600 A 5/1989 Lemke
4,842,912 A 6/1989 Hutter, III
4,843,848 A 7/1989 Igelmund
4,856,304 A 8/1989 Derman
4,856,305 A 8/1989 Adams
4,858,455 A 8/1989 Kuo
4,862,716 A 9/1989 Derman
4,869,082 A 9/1989 Appelbaum
4,870,840 A 10/1989 Klein
4,878,045 A 10/1989 Tanaka et al.
4,893,488 A 1/1990 Klein
4,896,140 A 1/1990 Biever
4,907,111 A 3/1990 Derman
4,907,716 A 3/1990 Wankel et al.
4,918,952 A 4/1990 Lakoski et al.
4,924,683 A 5/1990 Derman
4,924,693 A 5/1990 College
4,938,040 A 7/1990 Humphreys, Jr.
4,959,635 A 9/1990 Wilson
4,959,979 A 10/1990 Filipow et al.
4,964,285 A 10/1990 Lakoski
4,966,511 A 10/1990 Lee
4,969,342 A 11/1990 Marchiori
4,978,265 A 12/1990 De Wan
4,979,382 A 12/1990 Perry
4,985,695 A 1/1991 Wilkinson et al.
4,986,097 A 1/1991 Derman
4,993,244 A 2/1991 Osman
5,001,460 A 3/1991 Basson
5,001,854 A 3/1991 Derman
5,010,748 A 4/1991 Derman
5,022,242 A 6/1991 Povilaitis
5,024,072 A 6/1991 Lee
5,027,627 A 7/1991 Derman
5,050,836 A 9/1991 Makous
5,052,199 A 10/1991 Derman
5,063,763 A 11/1991 Johnson
5,066,942 A 11/1991 Matsuo
5,067,151 A 11/1991 Inagaki
5,076,079 A 12/1991 Monoson
5,082,232 A 1/1992 Wilson
5,082,233 A 1/1992 Ayers et al.
5,099,663 A 3/1992 Dearstine
5,117,661 A 6/1992 Carl et al.
5,119,649 A 6/1992 Spence
5,135,197 A 8/1992 Kelley et al.
5,138,785 A 8/1992 Paterson
5,146,769 A 9/1992 Smith
5,154,456 A 10/1992 Moore
5,184,798 A 2/1993 Wilson
5,197,706 A 3/1993 Braithwaite et al.
5,223,815 A 6/1993 Rosenthal et al.
D337,040 S 7/1993 Carl
5,228,319 A 7/1993 Holley et al.
5,279,136 A 1/1994 Perry
D346,733 S 5/1994 Carl et al.
5,317,304 A 5/1994 Choi
D347,987 S 6/1994 Carl et al.
5,327,752 A 7/1994 Myers et al.
D350,473 S 9/1994 Simon
5,349,834 A 9/1994 Davidge
5,351,507 A 10/1994 Derman
5,351,508 A 10/1994 Kelley
5,361,610 A 11/1994 Sanders
5,370,488 A 12/1994 Sykes
5,377,512 A 1/1995 Kelley
5,381,685 A 1/1995 Carl et al.
5,390,514 A 2/1995 Harmon
5,390,977 A 2/1995 Miller
5,394,713 A 3/1995 Harmon
5,397,176 A 3/1995 Leach
5,398,530 A 3/1995 Derman
5,400,622 A 3/1995 Harmon
5,406,809 A 4/1995 Igelmund
5,412,959 A 5/1995 Bentley
5,421,667 A 6/1995 Leyden et al.
5,446,618 A 8/1995 Tetsuya et al.
5,447,044 A 9/1995 Cheng
5,447,045 A 9/1995 Cheng et al.
5,466,022 A 11/1995 Derman
5,473,917 A 12/1995 Say
5,489,173 A 2/1996 Hofle
5,493,878 A 2/1996 Murray et al.
5,502,989 A 4/1996 Murray et al.
5,520,031 A 5/1996 Davidge
D370,473 S 6/1996 Derman
5,548,981 A 8/1996 Kirk
5,570,080 A 10/1996 Inoue et al.
5,579,657 A 12/1996 Makous
5,593,878 A 1/1997 Knopf et al.
5,603,416 A 2/1997 Richardson et al.
5,608,605 A 3/1997 Siow et al.
5,610,587 A 3/1997 Fujiuchi et al.
5,611,223 A 3/1997 Spitzer
5,622,064 A 4/1997 Gluskoter et al.
5,687,592 A 11/1997 Penniman et al.
5,692,400 A 12/1997 Bliven et al.
5,709,110 A 1/1998 Greenfield et al.
5,722,268 A 3/1998 Choi
5,787,738 A 8/1998 Brandt et al.
5,787,739 A 8/1998 Derman
5,791,171 A 8/1998 Kelley
5,794,463 A 8/1998 McDaid
5,799,520 A 9/1998 Laabs et al.
5,819,561 A 10/1998 Blehi, III
5,836,183 A 11/1998 Derman
5,870,281 A 2/1999 Kim
5,875,657 A 3/1999 Kelley
5,889,463 A 3/1999 Judd et al.
5,913,907 A 6/1999 Lee
5,960,651 A 10/1999 Tanisawa
5,963,131 A 10/1999 D'Angelo et al.
5,983,679 A 11/1999 Reyes
5,987,937 A 11/1999 Lee et al.
6,000,251 A 12/1999 Murray et al.
6,000,252 A 12/1999 Murray, Jr. et al.
6,006,557 A 12/1999 Carl et al.
6,038,891 A 3/2000 Zeren et al.
6,058,744 A 5/2000 Ling
6,081,974 A 7/2000 McDaid
6,087,939 A 7/2000 Leyden et al.
6,109,077 A 8/2000 Lee et al.
6,112,561 A 9/2000 Carl
6,112,562 A 9/2000 Murray, Jr. et al.
6,125,669 A * 10/2000 McDaid et al. ..... 70/58
6,133,830 A 10/2000 D'Angelo et al.
6,150,940 A 11/2000 Chapman et al.
6,155,088 A 12/2000 Murray, Jr. et al.
6,170,304 B1 1/2001 Ohta
6,173,591 B1 1/2001 Derman
6,182,481 B1 2/2001 Nagy
6,199,413 B1 3/2001 McDaid et al.
6,205,824 B1 3/2001 Miao
6,212,922 B1 4/2001 Miao
6,227,017 B1 5/2001 Igelmund
6,237,375 B1 5/2001 Wymer
6,244,080 B1 6/2001 Sakurai
6,244,082 B1 6/2001 Avgaanim
6,257,029 B1 7/2001 Liao

| | | | | |
|---|---|---|---|---|
| 6,262,664 | B1 | 7/2001 | Maloney | |
| 6,265,974 | B1 | 7/2001 | D'Angelo et al. | |
| 6,300,874 | B1 | 10/2001 | Rand | |
| 6,301,940 | B1 | 10/2001 | Derman et al. | |
| 6,308,928 | B1 | 10/2001 | Galant | |
| 6,317,936 | B1 | 11/2001 | McDaid et al. | |
| 6,360,405 | B1 | 3/2002 | McDaid et al. | |
| 6,389,853 | B1 | 5/2002 | Pate et al. | |
| 6,389,854 | B1 | 5/2002 | Huang | |
| 6,401,502 | B1 | 6/2002 | Yang | |
| 6,418,759 | B1 | 7/2002 | Zeren et al. | |
| 6,427,499 | B1 * | 8/2002 | Derman | 70/58 |
| 6,449,992 | B1 | 9/2002 | Yu | |
| 6,513,350 | B1 | 2/2003 | Hurd et al. | |
| 6,553,794 | B1 | 4/2003 | Murray, Jr. et al. | |
| 6,588,241 | B1 | 7/2003 | Murray, Jr. et al. | |
| 6,591,642 | B1 | 7/2003 | Kuo | |
| 6,598,433 | B1 | 7/2003 | Malvasio | |
| 6,619,080 | B1 | 9/2003 | Yu | |
| 6,619,081 | B1 | 9/2003 | Yu | |
| 6,621,415 | B1 | 9/2003 | Willis | |
| 6,735,990 | B1 | 5/2004 | Murray, Jr. et al. | |
| 6,758,069 | B2 * | 7/2004 | Derman | 70/58 |
| 6,763,688 | B1 * | 7/2004 | Syu | 70/14 |
| 6,763,690 | B2 * | 7/2004 | Galant | 70/58 |
| 6,886,376 | B2 | 5/2005 | Kuo | |
| 6,933,847 | B2 | 8/2005 | Feibelman | |
| 6,973,809 | B2 * | 12/2005 | Chang | 70/58 |
| 7,028,513 | B2 | 4/2006 | Avganim | |
| 2002/0134119 | A1 * | 9/2002 | Derman | 70/58 |
| 2003/0101778 | A1 | 6/2003 | Carl et al. | |
| 2004/0040350 | A1 | 3/2004 | Derman | |
| 2004/0206138 | A1 | 10/2004 | Murray et al. | |
| 2004/0261473 | A1 * | 12/2004 | Avganim | 70/58 |
| 2005/0150262 | A1 | 7/2005 | Murray et al. | |
| 2005/0150263 | A1 | 7/2005 | Murray et al. | |
| 2005/0178173 | A1 | 8/2005 | Kuo | |

FOREIGN PATENT DOCUMENTS

| | | | |
|---|---|---|---|
| CA | 791364 | | 8/1968 |
| CA | 987121 | | 4/1976 |
| DE | 329934 | | 12/1920 |
| DE | 335741 | | 4/1921 |
| DE | 361088 | | 4/1923 |
| DE | 456219 | | 2/1928 |
| DE | 577757 | | 8/1932 |
| DE | 3202700 | | 8/1983 |
| DE | 3407723 | A1 | 5/1985 |
| DE | 3824393 | | 7/1989 |
| FR | 455740 | | 8/1913 |
| FR | 877220 | | 12/1942 |
| FR | 1026519 | | 4/1953 |
| FR | 1085107 | | 1/1955 |
| FR | 2308006 | | 11/1976 |
| FR | 2636686 | A1 | 3/1990 |
| GB | 447091 | | 5/1936 |
| GB | 1256295 | | 12/1971 |
| GB | 1376011 | | 12/1974 |
| GB | 2109109 | A | 5/1983 |
| GB | 2234856 | A | 2/1991 |
| HU | P0000398 | | 6/2000 |
| HU | 224329 | | 6/2003 |
| IT | 451949 | | 10/1949 |
| JP | 37-7592 | | 9/1935 |
| JP | 49-91096 | | 11/1947 |
| JP | 52-36813 | | 3/1952 |
| JP | 57-25092 | | 2/1957 |
| JP | 57-179618 | | 11/1982 |
| JP | 2000-140948 | | 5/2005 |
| NO | 14095 | | 5/1905 |
| WO | 95/10680 | | 4/1985 |
| WO | 86/00396 | | 1/1986 |
| WO | 93/15295 | | 8/1993 |
| WO | 96/07002 | A1 | 3/1996 |

OTHER PUBLICATIONS

U.S. Appl. No. 09/441,142, Murray Jr., et al.
U.S. Appl. No. 09/603,240, Murray Jr., et al.
U.S. Appl. No. 09/804,973, Murray Jr., et al.
U.S. Appl. No. 10/455,072, Kuo.
U.S. Appl. No. 10/897,569, Francke.
U.S. Appl. No. 60/616,799, Merrem.
U.S. Appl. No. 10/970,060, Merrem.
U.S. Appl. No. 90/007,221, Murray Jr. et al.
U.S. Appl. No. 90/007,225, Carl et al.
U.S. Appl. No. 90/007,674, Myers et al.
U.S. Appl. No. 95/000,116, Murray Jr. et al.
U.S. Appl. No. 11/000,397, Merrem et al.
Kablit Security System Catalog, pp.7, 93, 1988. Computer and Office Equipment Security Catalog, 1990, Secure-It, Inc., 18 Maple Court, East Longmeadow, MA 01028.
Kensington Product Brochure for Kensington Apple Laser Writer and Macintosh Portable Security Systems, Computer and Office Equipment Security Catalog, 1990, Secure-It, Inc., 18 Maple Court, East Longmeadow, MA 01028.
Apple Security Bracket sold in AS kit.
Retaining Device Incorporated in Apple Computers.
Kensington MicroSaver Computer Lock Box and Literature, 3 pages.
Kensington Product News Release; "Kensington Wins Case Protecting Cable Lock Status", 2003, 1 page.
ACCO Brands, Inc. v. Micro Security Devices, Inc. Federal Circuit Court Order Granting Defendant's Motion for Summary Judgment, Jul. 23, 2002, 13 pages.
Maltoni, D. et al.; "Handbook of Fingerprint Recognition"; Chapter 1: Introduction, 2003, Springer, New York, pp. 1-52.
Passproof User Manual 1990, 5 pages.
Flexguard Security System, Philadelphia Security Products (no date on page) (1 page).
Los Angeles Times, Jan. 12, 1989, Part V, p. 10.
Kensington Microsaver Packaging and Manual (copyright 1992), 4 pages.
Targus DEFCON 1 Ultra Notebook Computer Security System, User's Guide, copyright 2001.
Targus DEFCON 1 Ultra Notebook Computer Security System; hyyp://www.targus.com/us/product_details.asp?sku=PA400U; Jan. 1, 2006; 2 pages.

* cited by examiner

PORTABLE ELECTRONIC DEVICE PHYSICAL SECURITY

CROSS-REFERENCES TO RELATED APPLICATIONS

This application is a continuation-in-part of U.S. patent application Ser. No. 09/930,122, filed Aug. 13, 2001, and now abandoned the disclosure of which is incorporated herein by reference in its entirety for all purposes.

STATEMENT AS TO RIGHTS TO INVENTIONS MADE UNDER FEDERALLY SPONSORED RESEARCH OR DEVELOPMENT

Not applicable

REFERENCE TO A "SEQUENCE LISTING," A TABLE, OR A COMPUTER PROGRAM LISTING APPENDIX SUBMITTED ON A COMPACT DISK

Not applicable

BACKGROUND OF THE INVENTION

The present invention relates generally to physical security for portable devices, and more specifically to physical security of portable electronic devices having a hinged member that overlies one or more operational interface elements.

Computer physical security devices are well known.

Many portable devices such as, for example, laptop computers and other portable electronic devices are manufactured having a portion of a housing wall provided with a specially designed security slot. Specifications for this slot have been promulgated by the assignee of the present invention as a standard. This standard may be found at Kensington's web page at http://www.kensington.com/developers/dev_1199.html, and is hereby expressly incorporated by reference for all purposes.

It is well known to provide physical locking devices designed to interface to this specially designed security slot. An exemplary product is the Kensington MICROSAVER® physical security product, as well as other preferred embodiments embodied in several issued US patents, including U.S. Pat. No. 5,327,752, issued Jul. 12, 1994—entitled "Computer Equipment Lock"; U.S. Pat. No. 5,381,685, issued Jan. 17, 1995—entitled "Computer Physical Security Device"; U.S. Pat. No. 6,000,251, issued Dec. 14, 1999—entitled "Computer Physical Security Device"; U.S. Pat. No. 5,502,989, issued Apr. 2, 1996—entitled "Computer Physical Security Device"; U.S. Pat. No. 5,493,878, issued Feb. 27, 1996—entitled "Computer Physical Security Device"; U.S. Pat. No. 6,155,088, issued Dec. 5, 2000—entitled "Computer Physical Security Device"; U.S. Pat. No. 6,000,252, issued Dec. 14, 1999—entitled "Computer Physical Security Device"; U.S. Pat. No. 6,112,562, issued Sep. 5, 2000—entitled "Computer Physical Security Device"; U.S. Pat. No. 6,006,557, issued Dec. 28, 1999—entitled "Computer Physical Security Device"; U.S. Pat. No. 6,112,561, issued Sep. 5, 2000—entitled "Security Device for a Portable Computer"; U.S. Pat. No. 5,787,739, issued Aug. 4, 1998—entitled "Security Hole Fastening Device"; U.S. Pat. No. 6,038,891, issued Mar. 21, 2000—entitled "Security Hole Fastening Device" and patent application Ser. No. 09/426,066, filed Oct. 22, 1999—entitled "Cable Locking Device"; Ser. No. 60/128,988, filed Apr. 12, 1999—entitled "Security Hole Fastening Device"; Ser. No. 09/532,382, filed Mar. 22, 2000—entitled "Slot Adapter" and Ser. No. 09/813,924—entitled "Physical Security Device and Method for Portable Device" for example, all hereby expressly incorporated by reference for all purposes.

These products are effective at deterring unauthorized movement of the portable device to which it is secured by localizing the portable device to a relatively immoveable object. The materials of the lock are designed so that the housing must be damaged in order to separate the lock from the portable device. By this expedient, unauthorized movement of the portable device is inhibited for several reasons. These reasons include a reluctance of a party to be observed damaging the housing as it would be obvious to observers that such party was unauthorized to tamper with the portable device. In addition, successfully separating the lock from the portable device in this fashion creates a damaged housing near the defeated security slot that is difficult, if not impossible, to repair, evidencing unauthorized possession of the portable device.

The products embodied in these incorporated patents serve as effective devices to inhibit the unauthorized movement of a portable electronic device beyond a predetermined distance from an object to which the portable electronic device is localized. Commonly, a flexible cable localizes an attachment mechanism to an object other than the portable electronic device, thereby limiting movement away from the object.

The attachment mechanism has a moveable locking member that engages a security slot defined in a wall of the portable device. The locking member, in an engagement configuration, cooperates with the security slot, the housing and possibly other elements of the attachment mechanism to inhibit reconfiguration of the locking member to a disengagement configuration in which the locking member may be disengaged from the security slot.

These solutions achieve a primary goal of such devices, namely to inhibit the unauthorized movement of the portable electronic device. For portable electronic devices that are secured in public or semi public areas, simple security against unauthorized movement is not sufficient to inhibit unauthorized use of the device while it is securely localized.

The prior art provides physical security solutions that do inhibit use of a portable electronic device while securing the device to a location. One such solution is a carrying case that completely surrounds the portable device and prevents any access or use of the device. A security device may simultaneously maintain the carrying case (with portable device inside) closed, and localized to an object. While this achieves the simultaneous goals of limiting access to the portable electronic device and inhibiting its movement, this solution is undesirable in situations in which a user desires convenient access to the portable electronic device. One such application is use of a laptop in a library or other public resource room. The user desires to access the laptop to records notes, for example, but inhibit operation and movement of the laptop while the user moves about the library. The user desires to quickly re access the laptop upon returning to the laptop's location. The carrying case solution is too cumbersome for all users in similar situations.

BRIEF SUMMARY OF THE INVENTION

The present invention is an efficient, cost effective and convenient physical security solution to the problem of providing access control to portable electronic devices while preserving anti movement characteristics.

The present invention provides an apparatus for attaching to a first wall that defines a security aperture. The apparatus comprises a housing defining a longitudinal axis and a locking flange extending from the housing on a shaft and having a profile that is complimentary to the security aperture, such that the locking flange has a first orientation relative to the security aperture for insertion into and removal from the security aperture, and a second orientation relative to the security aperture for retention within the security aperture. The locking flange is transformable between the first orientation and the second orientation. The apparatus further includes a locking member that is coupled to the housing and is cooperative with the locking flange for inhibiting transformation of the locking flange from the second orientation n to the first orientation. The apparatus further comprises at least one leg that is parallel to the first wall. The leg is coupled to the housing with a first coupler that is movable relative to the housing between an open position and a closed position.

In accordance with one aspect of the present invention, the apparatus further comprises a second leg coupled to the housing with a second coupler that is movable relative to the housing between an open position and a closed position.

In accordance with another aspect of the present invention, the second coupler is shorter than the first coupler.

In accordance with a further aspect of the present invention, the locking member comprises a first pin parallel to the shaft that extends into the security slot when the apparatus is in use.

In accordance with yet another aspect of the present invention, the pin is retractable.

In accordance with a further aspect of the present invention, the apparatus further comprises a second pin parallel to the shaft that extends into the security slot when the apparatus is in use. The first and second pins are located on opposite sides of the shaft.

In accordance with yet another aspect of the present invention, both pins are retractable.

In accordance with a further aspect of the present invention, the locking flange engages the first wall when in the second orientation.

These and other novel aspects of the present invention will be apparent to those of ordinary skill in the art upon review of the drawings and the remaining portions of the specification.

DETAILED DESCRIPTION OF THE INVENTION

Figure 1:
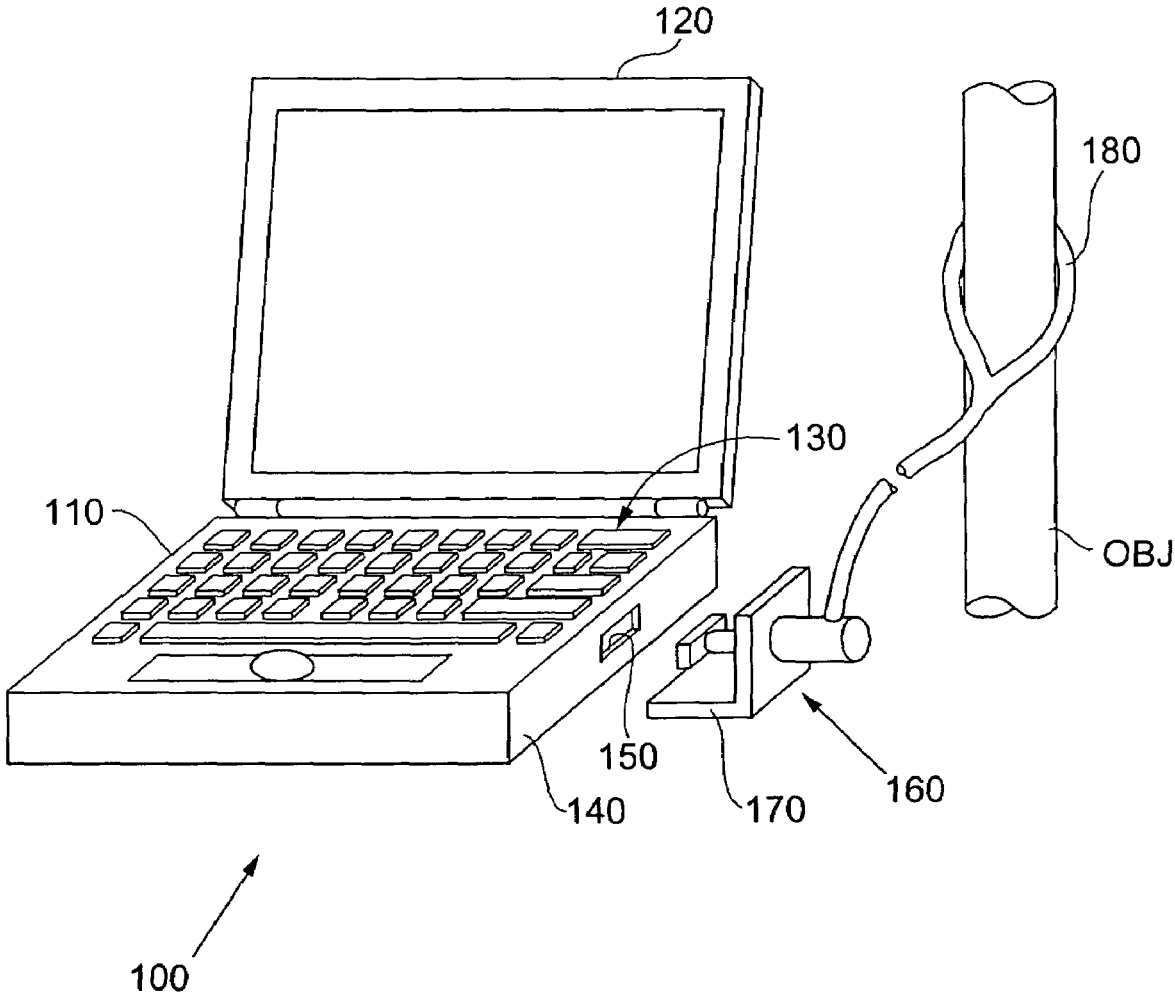
FIG. 1 is a perspective view of a locking system according to a preferred embodiment of the present invention.

FIG. 1 is a perspective view of a locking system 100 according to a preferred embodiment of the present invention. Locking system 100 includes a portable electronic device 110 having a hinged member 120 that has an opened configuration (as shown) permitting access to the keys and other operational interface elements 130 of device 110, and a closed configuration (not shown) in which hinged member 120 overlies operational interface elements 130 to inhibit access. Device 110 has a side wall 140 that defines a security aperture 150. Preferably, security aperture conforms to Kensington security standard.

Locking system 100 includes an attachment system 160 having an attachment device 170 and a localizer 180. Attachment system 160 has two configuration modes: an engagement/disengagement mode in which attachment device 170 may engage and disengage security aperture 150, and a lock mode in which attachment device 170 is attached to device 110 via engagement of security aperture 150.

Localizer 180, coupled to attachment device 170, localizes attachment system 160 an object OBJ that is something other than device 110. When attachment system 160 is in the lock mode and localizer 180 is localized to object OBJ, device 110 is also localized to object OBJ. Attachment system 160 preferably includes a lock (for example a tumbler, combination, or cable locking system) having a mechanism for maintaining attachment system 160 in the lock mode. As is explained later, attachment device 170 preferably includes two configurations: a first configuration for securing device 110 while hinged member 120 is in the opened configuration, and a second configuration for securing device 110 while hinged member 120 is in the closed configuration.

In operation, a user configures device 110 in either the opened or closed configuration and attachment system 160 (in the engagement configuration) engages security aperture 150. Attachment system 160 is transformed to the lock mode, and localizer 180 is localized to object OBJ to maintain device 110 within a predetermined distance of object OBJ. (Localizer 180 may be, depending upon application cable of attachment to object OBJ before or after connection to device 110.) Device 110 is secured in this fashion until attachment system 160 is transformed to a disengagement mode, freeing attachment system 160 from device 110. When attachment system 160 is engaged while hinged member 120 is in the closed configuration, attachment system 160 also maintains hinged member 120 in the closed configuration while concurrently localizing device 110 to object OBJ. In other applications, it may be preferable to secure device 110 in the closed configuration but it may not be necessary to localize device 110 to object OBJ. In this application, localizer 180 is not employed.

Device 110 is shown as a laptop computer. Device 110 can also be a personal digital assistant (PDA), electronic book reader, or other portable electronic device having a security aperture. Preferably, device 110 includes hinged member 120 that has a closed configuration. When attachment system 160 is in the locked configuration, attachment device 170 inhibits reconfiguration of hinged member to the opened configuration, inhibiting access and operation of operational interface elements 130.

However, in certain applications, device 110 may be equipped with a different type of access system. For example, a protective cover or access door that may be hinged or otherwise moveable (such as by sliding). Attachment system 160 may be adapted to work with these systems as well. In other applications, attachment device may be configured to selectively cover or otherwise inhibit access to a specific operational interface element 130. This is particularly simple when such specific operational interface element 130 is disposed on or near an edge or wall 140, or near security aperture 150. For example, an on/off switch may be covered by attachment device 170 when attachment system 160 is in the locked mode, disabling further operation or toggling of the on/off switch, for example.

Security aperture 150 is illustrated as being in a side wall 140 of device 110. Various applications provide for security aperture 150 to be in a back wall or even other placement. Attachment system 160 may be configured to operate with such other configurations. In the case when aperture 150 is in a back wall, and device 110 has hinged member 120 attached inward from a back edge, attachment device 170 may include an arm for overlying the top surface that is sufficiently long to interfere with transformation of hinged member 120 into the opened configuration.

Security aperture 150 is shown as a generally rectangular security slot having dimensions of about 7 millimeters by 3 millimeters. Other aperture configurations are possible and attachment system 160 may be adapted to engage such apertures.

Attachment system 160 includes an attachment device 170 having an 'L-shaped' member, but other configurations are also possible as will be further described below, for example. Attachment system 160 includes localizer 180 illustrated as a flexible cable. Other localization systems are possible, such as chain, monofilament, optic cable that initiates an alarm or other indication, or proximity detecting systems that issue an alarm or other indication if objects are separated beyond a pre-established distance.

Figure 2:
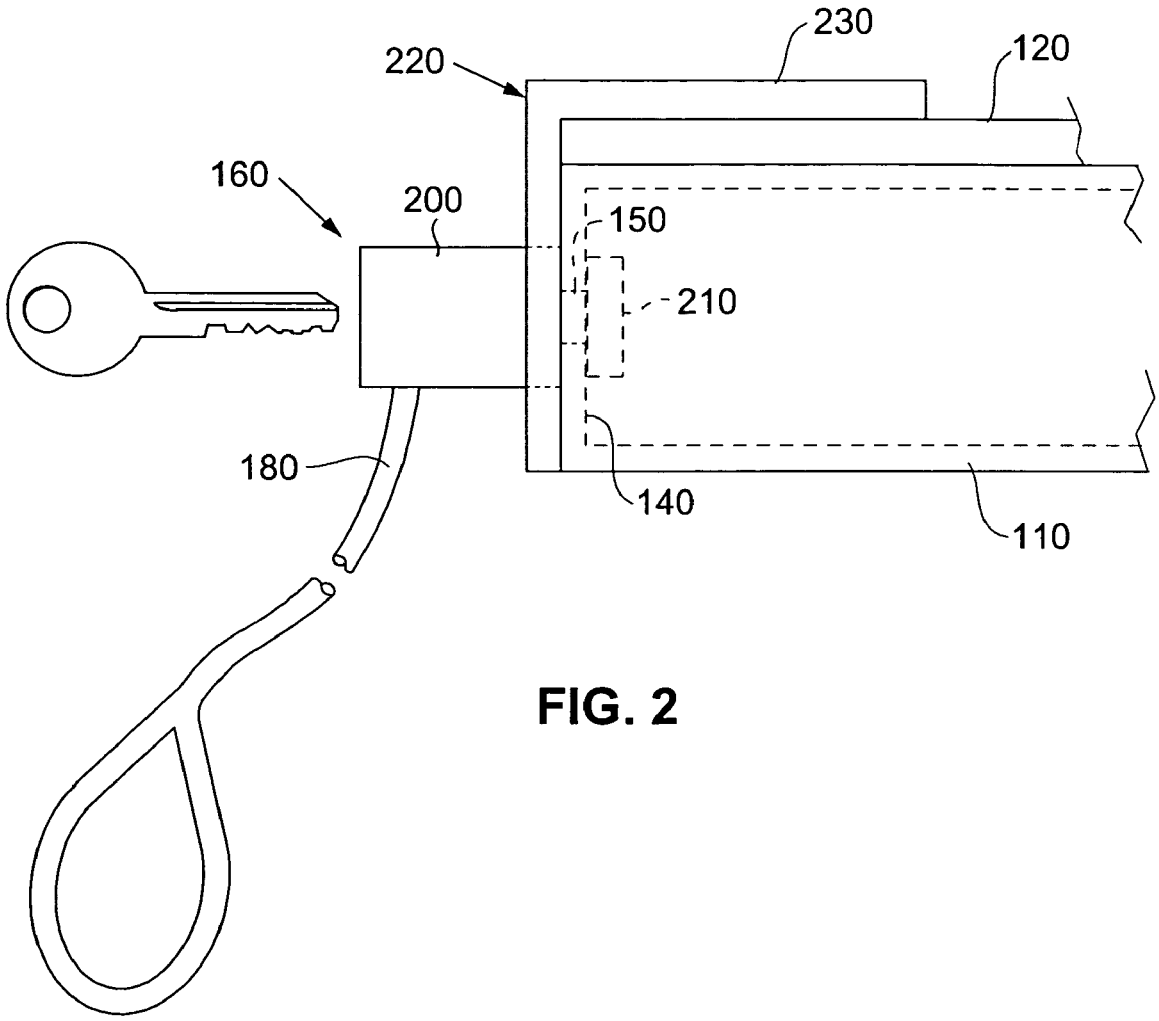
FIG. 2 is a perspective view of an attachment system according to a preferred embodiment of the present invention.

FIG. 2 is a perspective view of attachment system 160 according to a preferred embodiment of the present invention. Attachment system 160 includes a housing 200, a locking flange 210, and a locking member 220. Locking flange 210 extends from housing 200 and is sized so that it may be inserted into security aperture 150 in wall 140. In this preferred embodiment, locking flange 210 is a 'T-shaped' rotatable member that rotates about 90 degrees to engage/disengage and to lock. Locking member 220, also coupled to housing 200, cooperates with locking flange 210 to maintain locking flange 210 in the lock configuration relative to security aperture 150. Additionally, locking member 220 preferably includes an engagement arm 230 that extends past an edge of wall 140 when locking flange 210 is in a locking orientation relative to aperture 150.

When hinged member 120 is in the closed configuration, engagement arm 230 preferably extends beyond an edge of hinged member 120 to inhibit transformation of hinged member 120 to the open position, as shown. In an alternate use, such as for example when hinged member 120 is in the opened configuration, engagement arm 230 may be disposed along a bottomside of portable device 110.

Locking flange 210 may have other configurations than as described herein. Locking flange need not be 'T shaped' but may have other configurations, including embodiments having multiple legs that pivot, slide or otherwise transform from a first mode that may be used to engage security aperture 150, to a second mode that is secured to security aperture 150, and then to a third mode that may be used to disengage from security aperture 150. Typically the third mode is virtually the same as the first mode, but it need not necessarily be the same. While locking flange 210 is shown without cooperating pins disposed on lateral sides of a rotating shaft, it may be desirable to use such cooperating pins depending upon a particular application. Locking member 220 may be generally configured to cooperate with locking flange 210 to achieve a similar result as previously achieved with the cooperating pins, but when the particular application does not permit such configuration, one or more pins may be used.

In some applications, locking flange may include a single leg, that rotates to engage the aperture. In other applications, locking flange may be 'S shaped' and may, rotate less than 90 degrees (in some cases substantially less than 90 degrees) to engage aperture 150. Locking flange 210 may sized substantially smaller than the overall dimensions of security aperture 150, but is sized to conform to preselected dimensions of a portion of security aperture sufficient to achieve the desired attaching reliability.

In other applications, such as described below with respect to FIG. 3, locking member 220 may include two engagement arms that extend beyond a topmost and a bottommost edge of wall 140, for example.

Figure 3:
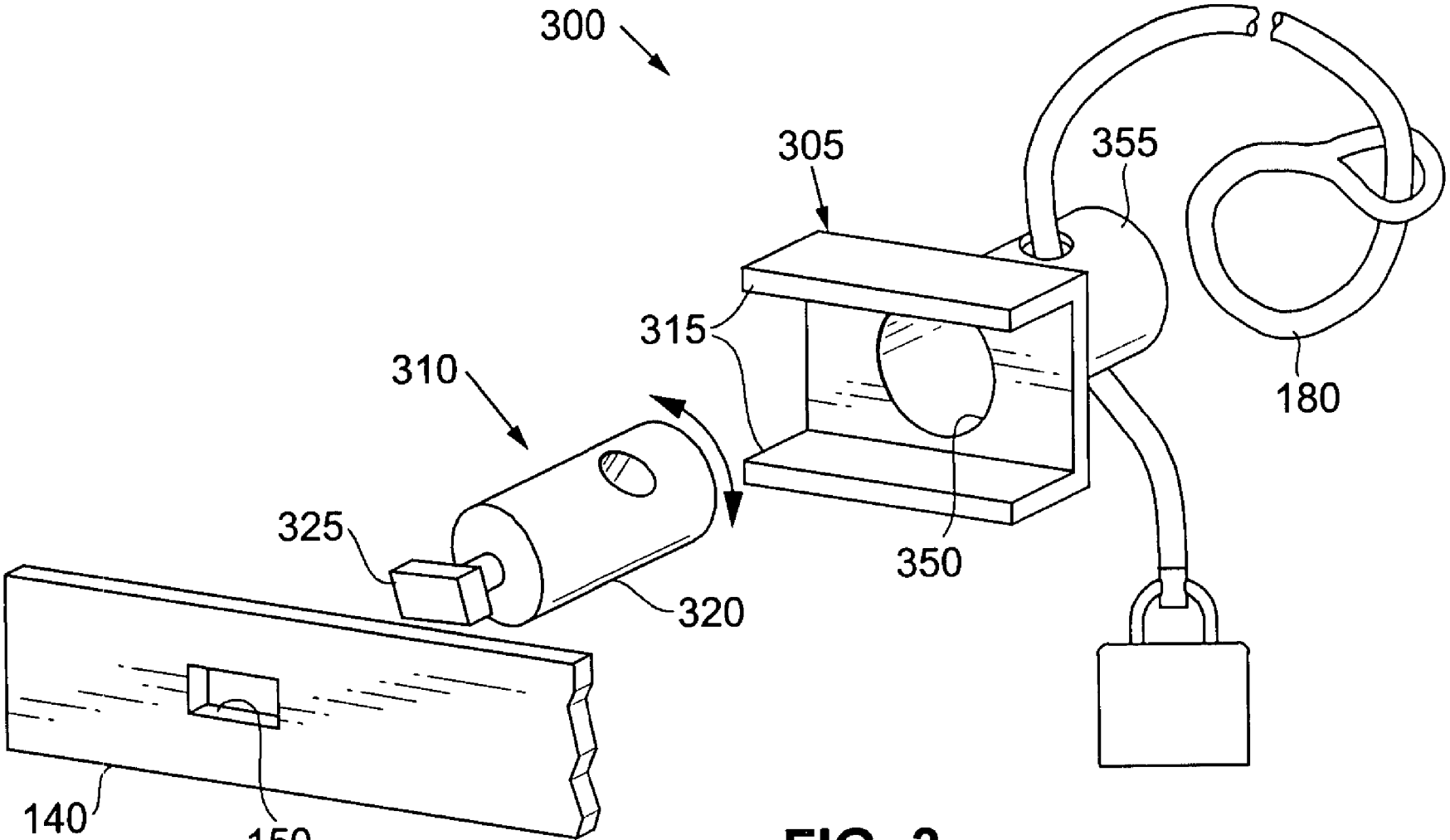
FIG. 3 is a perspective view of an alternate attachment system according to an alternate preferred embodiment.
Figure 4:
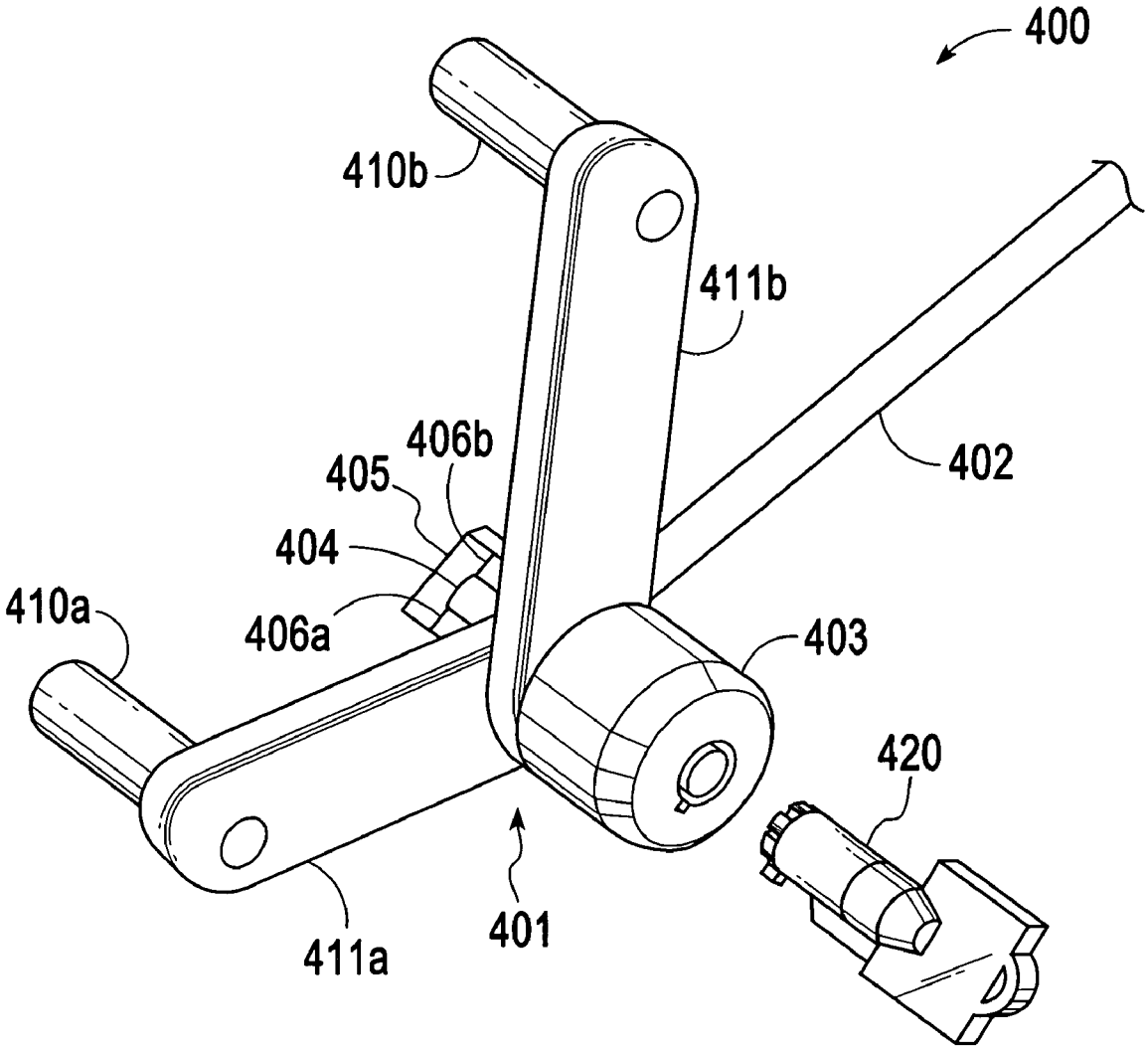
FIG. 4 is a perspective view of an alternative embodiment of an attachment system.
Figure 5:
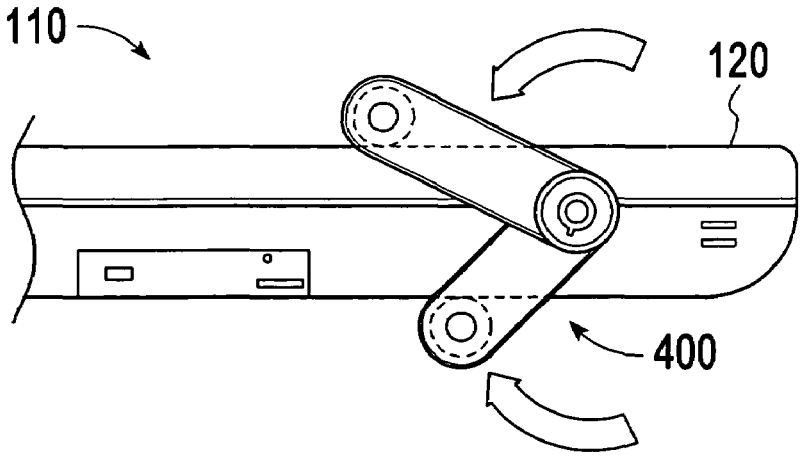
FIG. 5 is a side view of the attachment system illustrated in FIG. 4 in use.

FIG. 3 is a perspective view of an alternate attachment system 300 according to an alternate preferred embodiment. Attachment system 300 includes a housing 305, a locking flange 310, and a locking member 315 integrated into housing 305. Locking flange 310 is a separate structure from housing 305 and includes a head portion 320 and flange portion 325. Head portion 320 has a circular cross section and includes a first aperture passing through a diameter. Flange portion 325 includes a cross-member on a distal end of a shaft extending axially from head portion 320. The cross-member is sized to conform/complement preselected dimensions of security aperture 150 defined in wall 140. Wall 140 may be part of a wall of portable electronic device as shown in FIG. 1 and FIG. 2, or wall 140 may be a security adapter attached (such as for example by adhesive) to an object to be secured. The shaft is sized to permit flange portion 325 to extend past a thickness of wall 140 and flange portion 325 need not necessarily have a 'T shaped' configuration, as discussed above. Other configurations for locking flange 310 are possible, as long as the configuration is selectively engageable with, and disengageable from, security aperture 150.

Housing 305 includes a cavity 350 sized to receive head portion 320. Cavity 350 permits head portion 320 to pass through housing 350 and into a locking portion 355 of housing 305. Locking portion 355 has a circular cross section and includes a second aperture passing through a diameter. When locking flange 310 is in the locked configuration, and head portion 320 is received by cavity 350, the first and second apertures are aligned. When localizer 180 is a cable, bar padlock or other similar structure, it may be passed through the aligned apertures and thereby maintain housing 305 coupled to locking flange 310, and thereby maintain flange portion 325 in the engaged position.

Housing 305 further includes one or more locking members 315 that extend orthogonal, when attachment system 300 is in the lock configuration, to a plane defined by wall 140, and extend past an edge of wall 140. Each locking member 315 of the preferred embodiment is spaced a sufficient distance from a center point of aperture 150 to engage the edge. When a configuration is used that includes two locking members 315, they are separated by at least the width of wall 140 proximate security aperture 150. As discussed above, a locking member 315 may be moved further from the centerpoint, at least a thickness of hinged member 120 shown in FIG. 2, to permit housing 305 to engage locking flange 310 when hinged member 120 is in the closed configuration. In this embodiment, locking members 315 are sufficiently long to inhibit transformation of hinged member 120 into the open configuration. Additionally, in this embodiment, it may be that one locking member 315 is spaced a different distance from the center point of aperture 150 than another locking member 315 to account for possible non symmetries in aperture placement relative to edges of wall 140 and accounting for any additional thickness of hinged member 120. Alternatively, a locking member 315 may be constructed to have a variable or adaptable distance from the center point.

In accordance with an alternative embodiment of the present invention, a locking system 400 includes an attachment device 401 and a localizer 402. The attachment device includes a housing 403 from which a shaft 404 extends. At a distal end of the shaft, a locking flange 405 is provided. Preferably, two locking members 406*a*, 406*b* are provided adjacent the shaft, preferably in the form of pins. The pins may be retractable if desired. The locking flange has two configuration modes: an engagement/disengagement mode (first orientation) in which the locking flange may engage and disengage security aperture 150; and a lock mode (second orientation) in which the locking flange is attached to portable electronic device 110 via engagement of the security aperture.

Figure 6:
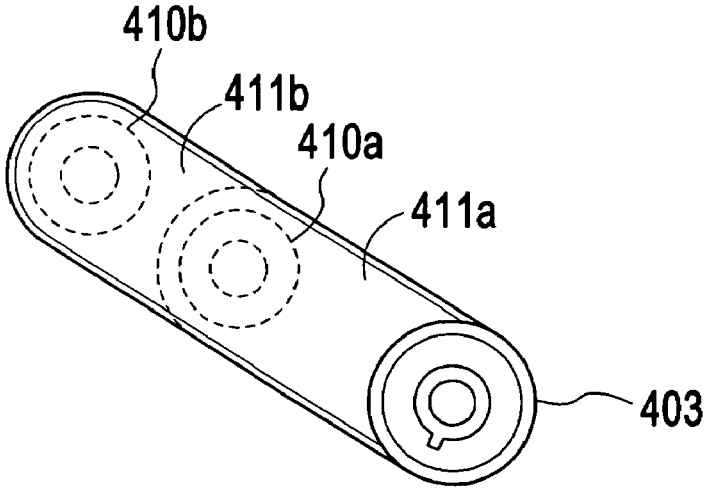
FIG. 6 is an end view of the system illustrated in FIG. 4 in a closed position.
Figure 7:
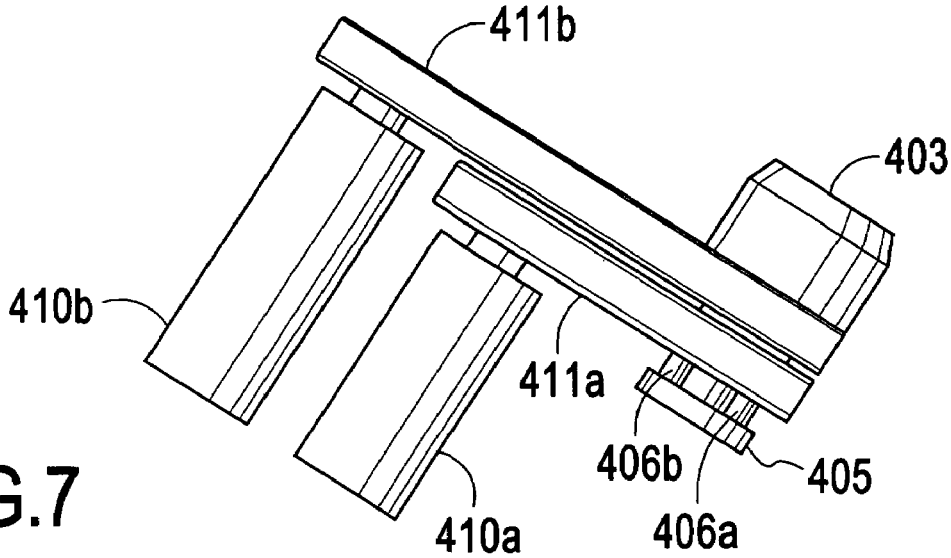
FIG. 7 is a side view of the system illustrated in FIG. 4 in the closed position.

Preferably, two parallel legs 410*a*, 410*b* are coupled to the housing with couplers 411*a*, 411*b*. Preferably, at least one coupler is able to rotate or move relative to the housing. As may be seen in FIGS. 6 and 7, coupler 411*a* is slightly shorter than coupler 411*b*, and thus, the couplers may move to a closed position so that the two legs are adjacent one another.

Preferably legs 410*a*, 410*b* may rotate relative to their respective couplers. Additionally, preferably the legs are at least covered with a fairly protective material such as, for example, plastic, nylon, foam, etc.

Preferably, the couplers may only rotate or open approximately 90 degrees relative to one another. This allows for portable electronic device 110 to be kept in a closed position, as may be seen in FIG. 6.

Thus, in use, localizer 402 is placed around an object as previously described and legs 410*a*, 410*b* are spread apart or opened. Locking flange 405 is placed within security aperture 150 while in the engage mode. Pins 406*a*, 406*b* are placed within the security aperture also. The locking flange is then moved to the lock mode, preferably with key 420. Removal of key 420 keeps the locking system in the lock mode. Pins 406*a*, 406*b* help prevent the attachment device from being manipulated so that the locking flange may be removed from the security aperture. Legs 410*a*, 410*b* also help in this regard and prevent the electronic device from being opened.

Those skilled in the art will understand that other lock configurations may be used with the leg arrangement of this embodiment. Furthermore, a single leg embodiment may also be used, where the single leg would be placed over hinged member 120. The single leg may or may not be rotatable or movable as desired.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An apparatus for attaching to a first wall defining a security aperture, comprising:

a housing defining a longitudinal axis;

a locking flange extending from said housing on a shaft and having a profile that is complimentary to the security aperture such that the locking flange has a first orientation relative to the security aperture for insertion into and removal from the security aperture and a second orientation relative to the security aperture for retention within the security aperture, the locking flange being transformable between the first orientation and the second orientation;

a locking member, coupled to the housing and cooperative with the locking flange, for inhibiting transformation of the locking flange from the second orientation to the first orientation; and at least one leg that is parallel to the first wall, the leg being coupled to the housing with a first coupler, and wherein the apparatus further comprises a second leg coupled to the housing with a second coupler that is movable relative to the housing between an open position and a closed position.

2. An apparatus in accordance with claim 1 wherein the second coupler is shorter than the first coupler.

3. An apparatus in accordance with claim 1 wherein the locking member comprises a first pin parallel to the shaft that extends into the security slot when the apparatus is in use.

4. An apparatus in accordance with claim 3 wherein the pin is retractable.

5. An apparatus in accordance with claim 3 comprising a second pin parallel to the shaft that extends into the security slot when the apparatus is in use, the first and second pins being located on opposite sides of the shaft.

6. An apparatus in accordance with claim 5 wherein the pins are retractable.

7. An apparatus in accordance with claim 1 wherein the locking flange engages the first wall when in the second orientation.

* * * * *